US009868915B2

(12) United States Patent
Smiley et al.

(10) Patent No.: US 9,868,915 B2
(45) Date of Patent: Jan. 16, 2018

(54) SLURRY HYDROCONVERSION AND COKING OF HEAVY OILS

(71) Applicants: Randolph J. Smiley, Hellertown, PA (US); Anjaneya Sarma Kovvali, Fairfax, VA (US); David G. Hammond, Fairfax, VA (US); Grace Shi Qian Yeo, Fairfax, VA (US)

(72) Inventors: Randolph J. Smiley, Hellertown, PA (US); Anjaneya Sarma Kovvali, Fairfax, VA (US); David G. Hammond, Fairfax, VA (US); Grace Shi Qian Yeo, Fairfax, VA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 853 days.

(21) Appl. No.: 14/308,867

(22) Filed: Jun. 19, 2014

(65) Prior Publication Data

US 2015/0008157 A1 Jan. 8, 2015

Related U.S. Application Data

(60) Provisional application No. 61/837,330, filed on Jun. 20, 2013.

(51) Int. Cl.

| | |
|---|---|
| ***C10G 69/14*** | (2006.01) |
| ***C10G 69/06*** | (2006.01) |
| ***C10G 45/16*** | (2006.01) |
| ***C10G 9/00*** | (2006.01) |
| ***C10G 31/09*** | (2006.01) |

(Continued)

(52) U.S. Cl.

CPC ..... *C10G 69/14* (2013.01); *C10G 9/005* (2013.01); *C10G 31/09* (2013.01); *C10G 45/16* (2013.01); *C10G 47/26* (2013.01); *C10G 49/12* (2013.01); *C10G 69/06* (2013.01); *C10G 2300/301* (2013.01)

(58) Field of Classification Search

CPC .. C10G 2300/301; C10G 45/16; C10G 47/26; C10G 49/12; C10G 69/06; C10G 69/14; C10G 9/005; C10G 9/00; C10G 99/00

See application file for complete search history.

(56) References Cited

U.S. PATENT DOCUMENTS

| | | | |
|---|---|---|---|
| 4,569,751 | A | 2/1986 | Eldt, Jr. et al. |
| 4,569,752 | A | 2/1986 | Aldridge et al. |
| 5,755,955 | A | 5/1998 | Benham et al. |

(Continued)

OTHER PUBLICATIONS

PCT Application No. PCT/US2014/043118, Communication from the International Searching Authority, Form PCT/ISA/220, dated Sep. 22, 2014, 8 pages.

*Primary Examiner* — Renee Robinson
*Assistant Examiner* — Derek N Mueller
(74) *Attorney, Agent, or Firm* — Andrew T. Ward; Chad A. Guice

(57) ABSTRACT

Systems and methods are provided for use of coking and slurry hydroconversion for conversion of heavy oil feeds. The combination of coking and slurry hydroconversion allows for improved yield of liquid products while reducing or minimizing the consumption of hydrogen in slurry hydroconversion reaction stages. Coking and slurry hydroconversion can be combined by segregating feeds based on Conradson carbon residue. Alternatively, slurry hydroconversion can be used to process unconverted bottoms from a coking process.

10 Claims, 3 Drawing Sheets

(51) Int. Cl.
*C10G 47/26* (2006.01)
*C10G 49/12* (2006.01)

(56) References Cited

U.S. PATENT DOCUMENTS

| | | | |
|---|---|---|---|
| 2009/0062590 | A1 | 3/2009 | Nadler et al. |
| 2009/0230022 | A1 | 9/2009 | Gorbaty et al. |
| 2010/0122939 | A1 | 5/2010 | Bauer et al. |
| 2011/0210045 | A1 | 9/2011 | Kou et al. |
| 2013/0075303 | A1 | 3/2013 | Heraud et al. |
| 2013/0112593 | A1 | 5/2013 | Montanari et al. |

SLURRY HYDROCONVERSION AND COKING OF HEAVY OILS

CROSS-REFERENCE TO RELATED APPLICATIONS

This application claims the benefit of priority from U.S. Provisional Application 61/837,330, filed on Jun. 20, 2013, titled "Slurry Hydroconversion and Coking of Heavy Oils", the entirety of which is incorporated herein by reference.

FIELD OF THE INVENTION

This invention provides methods for processing of resids and other heavy oil feeds or refinery streams.

BACKGROUND OF THE INVENTION

Slurry hydroconversion provides a method for conversion of high boiling, low value petroleum fractions into higher value liquid products. Slurry hydroconversion technology can process difficult feeds, such as feeds with high Conradson carbon residue (CCR), while still maintaining high liquid yields. In addition to resid feeds, slurry hydroconversion units have been used to process other challenging streams present in refinery/petrochemical complexes such as deasphalted rock, steam cracked tar, and visbreaker tar. Unfortunately, slurry hydroconversion is also an expensive refinery process from both a capital investment standpoint and a hydrogen consumption standpoint.

Various slurry hydroconversion configurations have previously been described. For example, U.S. Pat. No. 5,755,955 and U.S. Patent Application Publication 2010/0122939 provide examples of configurations for performing slurry hydroconversion. U.S. Patent Application Publication 2011/0210045 also describes examples of configurations for slurry hydroconversion, including examples of configurations where the heavy oil feed is diluted with a stream having a lower boiling point range, such as a vacuum gas oil stream and/or catalytic cracking slurry oil stream, and examples of configurations where a bottoms portion of the product from slurry hydroconversion is recycled to the slurry hydroconversion reactor.

U.S. Patent Application Publication 2013/0075303 describes a reaction system for combining slurry hydroconversion with a coking process. An unconverted portion of the feed after slurry hydroconversion is passed into a coker for further processing. The resulting coke is described as being high in metals. This coke can be combusted to allow for recovery of the metals or in a suitable disposal process. The recovered metals are described as being suitable for forming a catalytic solution for use as a catalyst in the slurry hydroconversion process.

U.S. Patent Application Publication 2013/0112593 describes a reaction system for performing slurry hydroconversion on a deasphalted heavy oil feed. The asphalt from a deasphalting process and a portion of the unconverted material from the slurry hydroconversion can be gasified to form hydrogen and carbon oxides.

SUMMARY OF THE INVENTION

In an aspect, a method for processing a heavy oil feedstock is provided. The method includes providing a first heavy oil feedstock having a 10% distillation point of at least about 650° F. (343° C.) and a first Conradson carbon residue wt %; providing a second heavy oil feedstock having a 10% distillation point of at least about 650° F. (343° C.) and a second Conradson carbon residue wt %, the second Conradson carbon residue wt % being at least 5 wt % greater than the first Conradson carbon residue wt %; coking the first heavy oil feedstock under effective coking conditions to form at least a first plurality of liquid products and coke; and exposing the second heavy oil feedstock to a catalyst under effective slurry hydroconversion conditions to form at least a second plurality of liquid products, the effective slurry hydroconversion conditions being effective for conversion of at least about 90 wt % of the second heavy oil feedstock relative to a conversion temperature.

In another aspect, a method for processing a heavy oil feedstock is provided. The method includes providing a heavy oil feedstock having a 10% distillation point of at least about 650° F. (343° C.); coking the heavy oil feedstock under effective coking conditions to form at least a first plurality of liquid products, coke, and an unconverted coker bottoms, the unconverted coker bottoms portion comprising about 5 wt % to about 25 wt % of the heavy oil feedstock, the unconverted bottoms portion having a 10% distillation point of at least about 900° F. (482° C.); exposing at least a first portion of the unconverted coker bottoms to a catalyst under effective slurry hydroconversion conditions to form at least a second plurality of liquid products, the effective slurry hydroconversion conditions being effective for conversion of at least about 90 wt % of the first portion of the unconverted coker bottoms relative to a conversion temperature.

DETAILED DESCRIPTION OF THE EMBODIMENTS

Overview

Figure 1:
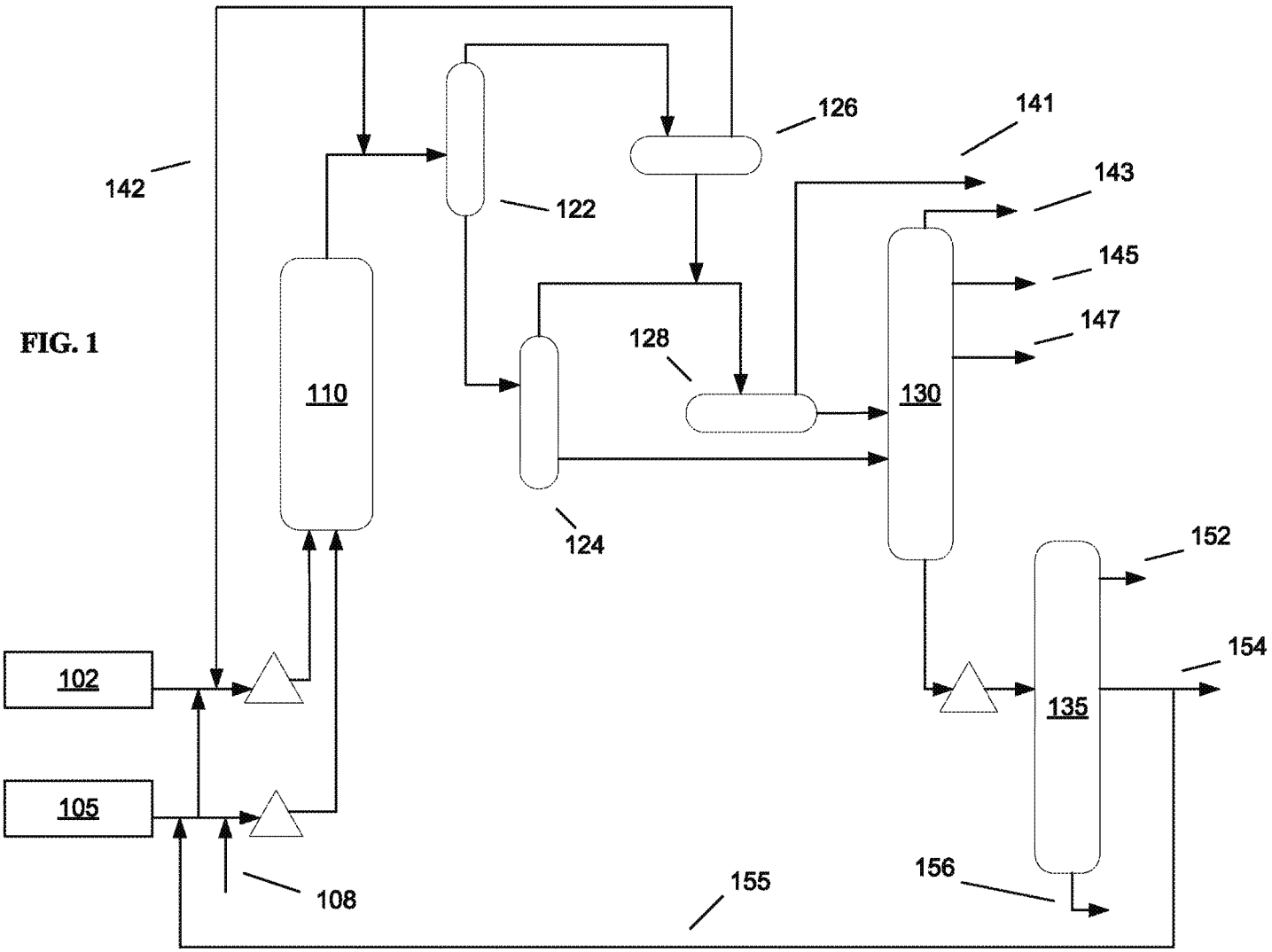
FIG. 1 shows an example of a slurry hydroconversion reaction system.

In various aspects, systems and methods are provided for hydroconversion of a heavy oil feed, such as an atmospheric or vacuum resid. The systems and methods allow for improved conversion of a heavy oil feed to lower boiling range products while reducing, minimizing, and/or optimizing the required hydrogen consumption.

In some aspects, the systems and methods allow for use of both coking and slurry hydroconversion of portions of a feed in order to provide a high conversion percentage while reducing, minimizing, and/or optimizing hydrogen consumption. One option is to separate a heavy oil feed into a higher Conradson carbon residue (CCR) portion and a lower CCR portion, such as via a membrane separation. The lower CCR portion (permeate from a membrane separation) can then be passed into a coker for conversion, while the higher CCR portion is converted using slurry hydroconversion. Another option is to process the pitch from a slurry hydroconversion reactor in a coker, but without passing the pitch or unconverted bottoms into the furnace for the coker. Bypassing the furnace with the pitch from slurry hydroconversion can reduce or minimize fouling in the coker furnace due to processing of a feed with high metals and CCR content. Still another option for integrating slurry hydroconversion with a coker is to operate a coker in a once-through mode with limited or no recycle of the unconverted coker bottoms back to the coking reaction. The portion of the unconverted coker bottoms that is not recycled is instead passed into a slurry hydroconversion reactor. This can allow for greater overall conversion of a feed to liquid products while reducing or minimizing the amount of hydrogen consumed during slurry hydroconversion.

Feedstocks

In various aspects, a hydroprocessed product is produced from a heavy oil feed component. Examples of heavy oils include, but are not limited to, heavy crude oils, distillation residues, heavy oils coming from catalytic treatment (such as heavy cycle bottom slurry oils from fluid catalytic cracking), thermal tars (such as oils from visbreaking, steam cracking, or similar thermal or non-catalytic processes), oils (such as bitumen) from oil sands and heavy oils derived from coal.

Heavy oil feedstocks can be liquid or semi-solid. Examples of heavy oils that can be hydroprocessed, treated or upgraded according to this invention include bitumens and residuum from refinery distillation processes, including atmospheric and vacuum distillation processes. Such heavy oils can have an initial boiling point of 650° F. (343° C.) or greater. Preferably, the heavy oils will have a 10% distillation point of at least 650° F. (343° C.), alternatively at least 660° F. (349° C.) or at least 750° F. (399° C.). In some aspects the 10% distillation point can be still greater, such as at least 900° F. (482° C.), or at least 950° F. (510° C.), or at least 975° F. (524° C.), or at least 1020° F. (549° C.) or at least 1050° F. (566° C.). In this discussion, boiling points can be determined by a convenient method, such as ASTM D86, ASTM D2887, or another suitable standard method.

In addition to initial boiling points and/or 10% distillation points, other distillation points may also be useful in characterizing a feedstock. For example, a feedstock can be characterized based on the portion of the feedstock that boils above 1050° F. (566° C.). In some aspects, a feedstock can have a 70% distillation point of 1050° F. (566° C.) or greater, or a 60% distillation point of 1050° F. (566° C.) or greater, or a 50% distillation point of 1050° F. (566° C.) or greater, or a 40% distillation point of 1050° F. or greater.

Density, or weight per volume, of the heavy hydrocarbon can be determined according to ASTM D287-92 (2006) Standard Test Method for API Gravity of Crude Petroleum and Petroleum Products (Hydrometer Method), and is provided in terms of API gravity. In general, the higher the API gravity, the less dense the oil. API gravity is 20° or less in one aspect, 15° or less in another aspect, and 10° or less in another aspect.

Heavy oil feedstocks (also referred to as heavy oils) can be high in metals. For example, the heavy oil can be high in total nickel, vanadium and iron contents. In one embodiment, the heavy oil will contain at least 0.00005 grams of Ni/V/Fe (50 ppm) or at least 0.0002 grams of Ni/V/Fe (200 ppm) per gram of heavy oil, on a total elemental basis of nickel, vanadium and iron. In other aspects, the heavy oil can contain at least about 500 wppm of nickel, vanadium, and iron, such as at least about 1000 wppm.

Contaminants such as nitrogen and sulfur are typically found in heavy oils, often in organically-bound form. Nitrogen content can range from about 50 wppm to about 10,000 wppm elemental nitrogen or more, based on total weight of the heavy hydrocarbon component. The nitrogen containing compounds can be present as basic or non-basic nitrogen species. Examples of basic nitrogen species include quinolines and substituted quinolines. Examples of non-basic nitrogen species include carbazoles and substituted carbazoles.

The invention is particularly suited to treating heavy oil feedstocks containing at least 500 wppm elemental sulfur, based on total weight of the heavy oil. Generally, the sulfur content of such heavy oils can range from about 500 wppm to about 100,000 wppm elemental sulfur, or from about 1000 wppm to about 50,000 wppm, or from about 1000 wppm to about 30,000 wppm, based on total weight of the heavy component. Sulfur will usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, and di- and polysulfides.

Heavy oils can be high in n-pentane asphaltenes. In some aspects, the heavy oil can contain at least about 5 wt % of n-pentane asphaltenes, such as at least about 10 wt % or at least 15 wt % n-pentane asphaltenes.

Still another method for characterizing a heavy oil feedstock is based on the Conradson carbon residue of the feedstock. The Conradson carbon residue of the feedstock can be at least about 5 wt %, such as at least about 10 wt % or at least about 20 wt %. Additionally or alternately, the Conradson carbon residue of the feedstock can be about 50 wt % or less, such as about 40 wt % or less or about 30 wt % or less.

In various aspects of the invention, reference may be made to one or more types of fractions generated during distillation of a petroleum feedstock. Such fractions may include naphtha fractions, kerosene fractions, diesel fractions, and vacuum gas oil fractions. Each of these types of fractions can be defined based on a boiling range, such as a boiling range that includes at least 90 wt % of the fraction, and preferably at least 95 wt % of the fraction. For example, for many types of naphtha fractions, at least 90 wt % of the fraction, and preferably at least 95 wt %, can have a boiling point in the range of 85° F. (29° C.) to 350° F. (177° C.). For some heavier naphtha fractions, at least 90 wt % of the fraction, and preferably at least 95 wt %, can have a boiling point in the range of 85° F. (29° C.) to 400° F. (204° C.). For a kerosene fraction, at least 90 wt % of the fraction, and preferably at least 95 wt %, can have a boiling point in the range of 300° F. (149° C.) to 600° F. (288° C.). Alternatively, for a kerosene fraction targeted for some uses, such as jet fuel production, at least 90 wt % of the fraction, and preferably at least 95 wt %, can have a boiling point in the range of 300° F. (149° C.) to 550° F. (288° C.). For a diesel fraction, at least 90 wt % of the fraction, and preferably at least 95 wt %, can have a boiling point in the range of 400° F. (204° C.) to 750° F. (399° C.).

Slurry Hydroconversion

FIG. 1 shows an example of a reaction system suitable for performing slurry hydroconversion. The configuration in FIG. 1 is provided as an aid in understanding the general features of a slurry hydroconversion process. It should be understood that, unless otherwise specified, the conditions described in association with FIG. 1 can generally be applied to any convenient slurry hydroconversion configuration.

In FIG. 1, a heavy oil feedstock 105 is mixed with a catalyst 108 prior to entering one or more slurry hydroconversion reactors 110. The mixture of feedstock 105 and catalyst 108 can be heated prior to entering reactor 110 in order to achieve a desired temperature for the slurry hydroconversion reaction. A hydrogen stream 102 is also fed into reactor 110. In the configuration shown in FIG. 1, both the feedstock 105 and hydrogen stream 102 are shown as being heated prior to entering reactor 110. Optionally, a portion of feedstock 105 can be mixed with hydrogen stream 102 prior to hydrogen stream 102 entering reactor 110. Optionally, feedstock 105 can also include a portion of recycled vacuum gas oil 155. Optionally, hydrogen stream 102 can also include a portion of recycled hydrogen 142.

The effluent from slurry hydroconversion reactor(s) 110 is passed into one or more separation stages. For example, an initial separation stage can be a high pressure, high temperature (HPHT) separator 122. A higher boiling portion from the HPHT separator 122 can be passed to a low pressure, high temperature (LPHT) separator 124 while a lower boiling (gas) portion from the HPHT separator 122 can be passed to a high temperature, low pressure (HTLP) separator 126. The higher boiling portion from the LPHT separator 124 can be passed into a fractionator 130. The lower boiling portion from LPHT separator 124 can be combined with the higher boiling portion from HPLT separator 126 and passed into a low pressure, low temperature (LPLT) separator 128. The lower boiling portion from HPLT separator 126 can be used as a recycled hydrogen stream 142, optionally after removal of gas phase contaminants from the stream such as $H_2S$ or $NH_3$. The lower boiling portion from LPLT separator 128 can be used as a flash gas or fuel gas 141. The higher boiling portion from LPLT separator 128 is also passed into fractionator 130.

In some configurations, HPHT separator 122 can operate at a temperature similar to the outlet temperature of the slurry HDC reactor 110. This reduces the amount of energy required to operate the HPHT separator 122. However, this also means that both the lower boiling portion and the higher boiling portion from the HPHT separator 122 undergo the full range of distillation and further processing steps prior to any recycling of unconverted feed to reactor 110.

In an alternative configuration, the higher boiling portion from HPHT separator 122 is used as a recycle stream 118 that is added back into feed 105 for processing in reactor 110. In this type of alternative configuration, the effluent from reactor 110 can be heated to reduce the amount of converted material that is recycled via recycle stream 118. This allows the conditions in HPHT separator 122 to be separated from the reaction conditions in reactor 110.

In FIG. 1, fractionator 130 is shown as an atmospheric fractionator. The fractionator 130 can be used to form a plurality of product streams, such as a light ends or $C_4^-$ stream 143, one or more naphtha streams 145, one or more diesel and/or distillate (including kerosene) fuel streams 147, and a bottoms fraction. The bottoms fraction can then be passed into vacuum fractionator 135 to form, for example, a light vacuum gas oil 152, a heavy vacuum gas oil 154, and a bottoms or pitch fraction 156. Optionally, other types and/or more types of vacuum gas oil fractions can be generated from vacuum fractionator 135. The heavy vacuum gas oil fraction 154 can be at least partially used to form a recycle stream 155 for combination with heavy oil feed 105.

In a reaction system, slurry hydroconversion can be performed by processing a feed in one or more slurry hydroconversion reactors. The reaction conditions in a slurry hydroconversion reactor can vary based on the nature of the catalyst, the nature of the feed, the desired products, and/or the desired amount of conversion.

With regard to catalyst, suitable catalyst concentrations can range from about 50 wppm to about 20,000 wppm (or about 2 wt %), depending on the nature of the catalyst. Catalyst can be incorporated into a hydrocarbon feedstock directly, or the catalyst can be incorporated into a side or slip stream of feed and then combined with the main flow of feedstock. Still another option is to form catalyst in-situ by introducing a catalyst precursor into a feed (or a side/slip stream of feed) and forming catalyst by a subsequent reaction.

Catalytically active metals for use in hydroconversion can include those from Group IVB, Group VB, Group VIB, Group VIIB, or Group VIII of the Periodic Table. Examples of suitable metals include iron, nickel, molybdenum, vanadium, tungsten, cobalt, ruthenium, and mixtures thereof. The catalytically active metal may be present as a solid particulate in elemental form or as an organic compound or an inorganic compound such as a sulfide (e.g., iron sulfide) or other ionic compound. Metal or metal compound nanoaggregates may also be used to form the solid particulates.

A catalyst in the form of a solid particulate is generally a compound of a catalytically active metal, or a metal in elemental form, either alone or supported on a refractory material such as an inorganic metal oxide (e.g., alumina, silica, titania, zirconia, and mixtures thereof). Other suitable refractory materials can include carbon, coal, and clays. Zeolites and non-zeolitic molecular sieves are also useful as solid supports. One advantage of using a support is its ability to act as a "coke getter" or adsorbent of asphaltene precursors that might otherwise lead to fouling of process equipment.

In some aspects, it can be desirable to form catalyst for slurry hydroconversion in situ, such as forming catalyst from a metal sulfate (e.g., iron sulfate monohydrate) catalyst precursor or another type of catalyst precursor that decomposes or reacts in the hydroconversion reaction zone environment, or in a pretreatment step, to form a desired, well-dispersed and catalytically active solid particulate (e.g., as iron sulfide). Precursors also include oil-soluble organometallic compounds containing the catalytically active metal of interest that thermally decompose to form the solid particulate (e.g., iron sulfide) having catalytic activity. Other suitable precursors include metal oxides that may be converted to catalytically active (or more catalytically active) compounds such as metal sulfides. In a particular embodiment, a metal oxide containing mineral may be used as a precursor of a solid particulate comprising the catalytically active metal (e.g., iron sulfide) on an inorganic refractory metal oxide support (e.g., alumina).

The reaction conditions within a slurry hydroconversion reactor can include a temperature of about 400° C. to about 480° C., such as at least about 425° C., or about 450° C. or less. Some types of slurry hydroconversion reactors are operated under high hydrogen partial pressure conditions, such as having a hydrogen partial pressure of about 1200 psig (8.3 MPag) to about 3400 psig (23.4 MPag), for example at least about 1500 psig (10.3 MPag), or at least about 2000 psig (13.8 MPag). Examples of hydrogen partial pressures can be about 1200 psig (8.3 MPag) to about 3000 psig (20.7 MPag), or about 1200 psig (8.3 MPag) to about 2500 psig (17.2 MPag), or about 1500 psig (10.3 MPag) to about 3400 psig (23.4 MPag), or about 1500 psig (10.3 MPag) to about 3000 psig (20.7 MPag), or about 1500 psig (8.3 MPag) to about 2500 psig (17.2 MPag), or about 2000 psig (13.8 MPag) to about 3400 psig (23.4 MPag), or about 2000 psig (13.8 MPag) to about 3000 psig (20.7 MPag). Since the catalyst is in slurry form within the feedstock, the space velocity for a slurry hydroconversion reactor can be characterized based on the volume of feed processed relative to the volume of the reactor used for processing the feed. Suitable space velocities for slurry hydroconversion can range, for example, from about 0.05 $v/v/hr^{-1}$ to about 5 $v/v/hr^{-1}$, such as about 0.1 $v/v/hr^{-1}$ to about 2 $v/v/hr^{-1}$.

The reaction conditions for slurry hydroconversion can be selected so that the net conversion of feed across all slurry hydroconversion reactors (if there is more than one arranged in series) is at least about 80%, such as at least about 90%, or at least about 95%. For slurry hydroconversion, conversion is defined as conversion of compounds with boiling points greater than a conversion temperature, such as 975° F. (524° C.), to compounds with boiling points below the conversion temperature. Alternatively, the conversion temperature for defining the amount of conversion can be 1050° F. (566° C.). The portion of a heavy feed that is unconverted after slurry hydroconversion can be referred to as pitch or a bottoms fraction from the slurry hydroconversion.

Hydrotreatment Conditions

After slurry hydroconversion, an initial hydrotreatment stage can be used to further reduce the amount of heteroatom contaminants in the slurry hydroconversion products. Hydrotreatment is typically used to reduce the sulfur, nitrogen, and aromatic content of a feed. The catalysts used for hydrotreatment of the heavy portion of the crude oil from the flash separator can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base oil) boiling range feed in a conventional manner may be used. It is within the scope of the present invention that more than one type of hydroprocessing catalyst can be used in one or multiple reaction vessels.

The at least one Group VIII non-noble metal, in oxide form, can typically be present in an amount ranging from about 2 wt % to about 40 wt %, preferably from about 4 wt % to about 15 wt %. The at least one Group VI metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

In some aspects, a hydrotreatment stage can be operated under conditions that are influenced by the conditions in the slurry hydroconversion reactor. For example, the effluent from slurry hydroconversion can be separated using a high pressure separator, operating at roughly the pressure of the slurry hydroconversion reactor, and then passed into the hydrotreatment reactor. In this type of aspect, the pressure in the hydrotreatment reactor can be the same as or similar to the pressure in the slurry hydroconversion reactor. In other aspects, after separation the fuels and gas phase products from the slurry hydroconversion reactor can be passed into a hydrotreatment reactor. This allows hydrogen originally passed into the slurry hydroconversion reactor to be used as the hydrogen source for hydrotreatment.

Delayed Coking and Fluidized Coking

In various embodiments, slurry hydroconversion can be used in conjunction with coking to improve the overall yield for processing of heavy oil feeds. Typical configurations for coking can include fluidized coking and delayed coking.

Fluidized coking is a refinery process in which a heavy petroleum feedstock, typically a non-distillable residue (resid) from atmospheric and/or vacuum fractionation, is converted to lighter, more valuable materials by thermal decomposition (coking) at temperatures from about 900° F. (482° C.) to about 1100° F. (593° C.). Conventional fluid coking is performed in a process unit comprised of a coking reactor and a heater or burner. A petroleum feedstock is injected into the reactor in a coking zone comprised of a fluidized bed of hot, fine, coke particles and is distributed relatively uniformly over the surfaces of the coke particles where it is cracked to vapors and coke. The vapors pass through a gas/solids separation apparatus, such as a cyclone, which removes most of the entrained coke particles. The vapor is then discharged into a scrubbing zone where the remaining coke particles are removed and the products cooled to condense the heavy liquids. The resulting slurry, which usually contains from about 1 to about 3 wt. % coke particles, is recycled to extinction to the coking zone. The balance of the vapors go to a fractionator for separation of the gases and the liquids into different boiling fractions.

Some of the coke particles in the coking zone flow downwardly to a stripping zone at the base of the reactor vessel where steam removes interstitial product vapors from, or between, the coke particles, and some adsorbed liquids from the coke particles. The coke particles then flow down a stand-pipe and into a riser that moves them to a burning, or heating zone, where sufficient air is injected to burn at least a portion of the coke and heating the remainder sufficiently to satisfy the heat requirements of the coking zone where the unburned hot coke is recycled. Net coke, above that consumed in the burner, is withdrawn as product coke.

Another type of fluid coking employs three vessels: a coking reactor, a heater, and a gasifier. Coke particles having carbonaceous material deposited thereon in the coking zone are passed to the heater where a portion of the volatile matter is removed. The coke is then passed to the gasifier where it reacts, at elevated temperatures, with air and steam to form a mixture of carbon monoxide, carbon dioxide, methane, hydrogen, nitrogen, water vapor, and hydrogen sulfide. The gas produced in the gasifier is passed to the heater to provide part of the reactor heat requirement. The remainder of the heat is supplied by circulating coke between the gasifier and the heater. Coke is also recycled from the heater to the coking reactor to supply the heat requirements of the reactor.

The rate of introduction of resid feedstock to a fluid coker is limited by the rate at which it can be converted to coke. The major reactions that produce coke involve cracking of aliphatic side chains from aromatic cores, demethylation of aromatic cores and aromatization. The rate of cracking of aliphatic side chains is relatively fast and results in the buildup of a sticky layer of methylated aromatic cores. This layer is relatively sticky at reaction temperature. The rate of de-methylation of the aromatic cores is relatively slow and limits the operation of the fluid coker. At the point of fluid bed bogging (defluidizing), the rate of sticky layer going to coke equals the rate of introduction of coke precursors from the resid feed. An acceleration of the reactions involved in converting the sticky material to dry coke would allow increased reactor throughput at a given temperature or coking at a lower temperature at constant throughput. Less gas and higher quality liquids are produced at lower coking temperatures. Sticky coke particles can agglomerate (become larger) and be carried under into the stripper section and cause fouling. When carried under, much of the sticky coke is sent to the burner, where this incompletely demethylated coke evolves methylated and unsubstituted aromatics via thermal cracking reactions that ultimately cause fouling and/or foaming problems in the acid gas clean-up units.

Figure 2:
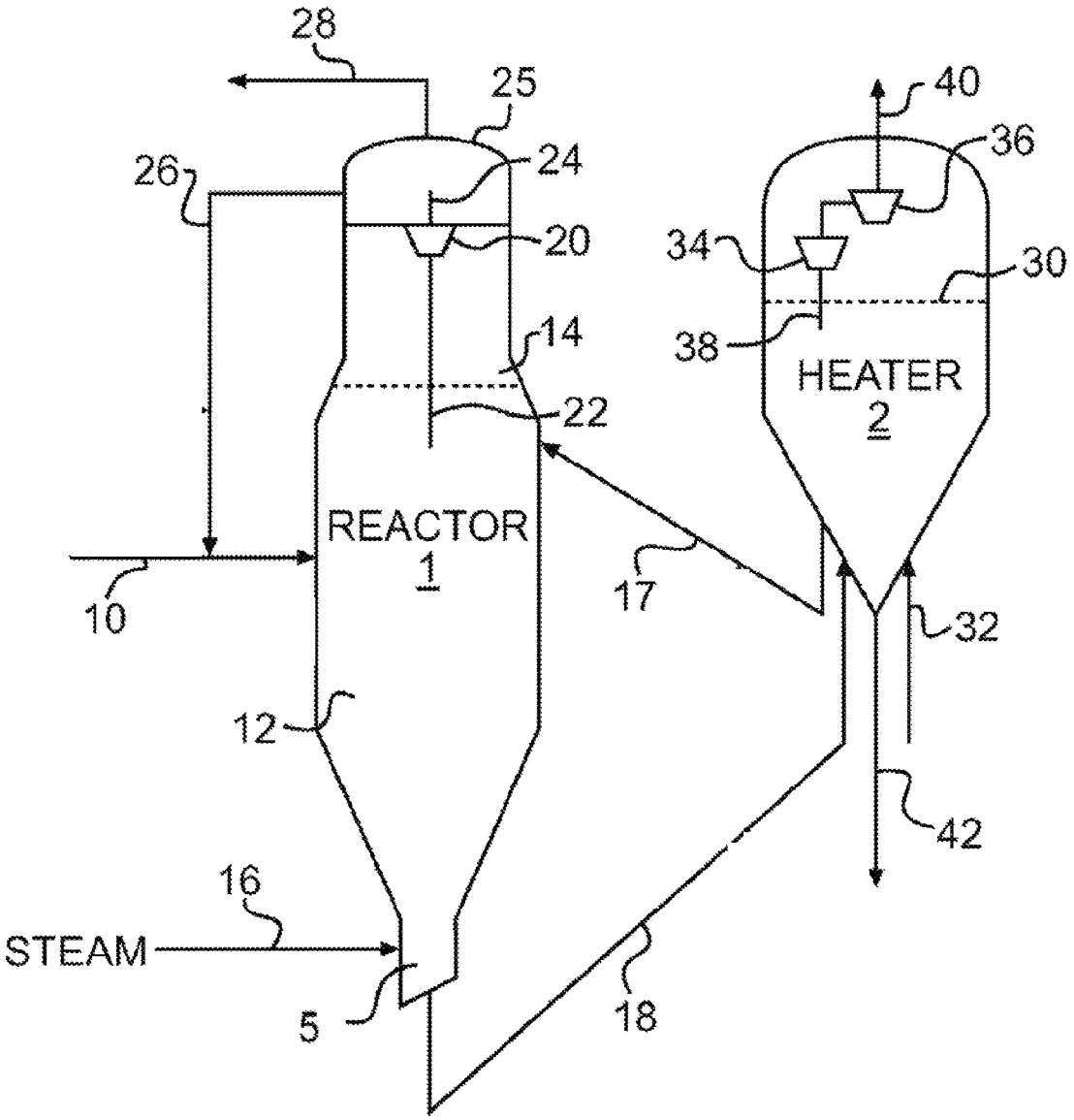
FIG. 2 shows an example of a fluidized coking system.

Reference is now made to FIG. 2 hereof which shows a simplified flow diagram of a typical fluidized coking process unit comprised of a coking reactor and a heater. A heavy hydrocarbonaceous chargestock is conducted via line 10 into coking zone 12 that contains a fluidized bed of solids having an upper level indicated at 14. Although it is preferred that the solids, or seed material, be coke particles, they may also be any other refractory materials such as those selected from the group consisting of silica, alumina, zirconia, magnesia, alundum or mullite, synthetically prepared or naturally occurring material such as pumice, clay, kieselguhr, diatomaceous earth, bauxite, and the like. The solids will have an average particle size of about 40 to 1000 microns, preferably from about 40 to 400 microns. For purposes of this FIG. 2, the solid particles will be referred to coke, or coke particles.

A fluidizing gas e.g., steam, is introduced at the base of coker reactor 1, through line 16, in an amount sufficient to obtained superficial fluidizing velocity in the range of about 0.5 to 5 feet/second (0.15 to 1.5 m/s). Coke at a temperature above the coking temperature, for example, at a temperature from about 100° F. (38° C.) to about 400° F. (204° C.), preferably from about 150° F. (65° C.) to about 350° F. (177° C.), and more preferably from about 150° F. (65° C.) to 250° F. (121), in excess of the actual operating temperature of the coking zone is admitted to reactor 1 by line 17 from heater 2 in an amount sufficient to maintain the coking temperature in the range of about 850° F. (454° C.) to about 1200° F. (650° C.). The pressure in the coking zone is maintained in the range of about 0 to 150 psig (1030 kPag), preferably in the range of about 5 psig (34 kPag) to 45 psig (310 kPag). The lower portion of the coking reactor serves as a stripping zone 5 in which occluded hydrocarbons are removed from the coke by use of a stripping agent, such as steam, as the coke particles move through the stripping zone. A stream of stripped coke is withdrawn from the stripping zone 5 via line 18 and conducted to heater 2. Conversion products of the coking zone are passed through cyclone(s) 20 where entrained solids are removed and returned to coking zone 12 via dipleg 22. The resulting vapors exit cyclone 20 via line 24, and pass into a scrubber 25 mounted at the top of the coking reactor 1. The vapors passed into scrubber 25 are cooled and the heaviest components can be condensed. If desired, a stream of heavy materials condensed in the scrubber may be recycled to the coking reactor via line 26. Coker conversion products are removed from scrubber 25 via line 28 for fractionation in a conventional manner. In heater 2, stripped coke from coking reactor 1 (cold coke) is introduced via line 18 into a fluidized bed of hot coke having an upper level indicated at 30. The bed is heated by passing a fuel gas and/or air into the heater via line 32. The gaseous effluent of the heater, including entrained solids, passes through one or moer cyclones which may include first cyclone(s) 34 and second cyclone(s) 36 wherein the separation of the larger entrained solids occur. The separated larger solids are returned to the heater via cyclone diplegs 38. The heated gaseous effluent that contains entrained solids is removed from heater 2 via line 40. Excess coke can be removed from heater 2 via line 42. A portion of hot coke is removed from the fluidized bed in heater 2 and recycled to coking reactor 1 via line 17 to supply heat to the coking zone. Although a gasifier can also be present as part of a coking reaction system, a gasifier is not shown in FIG. 2.

Delayed coking is another process suitable for the thermal conversion of heavy oils such as petroleum residua (also referred to as "resid") to produce liquid and vapor hydrocarbon products and coke. Delayed coking of resids from heavy and/or sour (high sulfur) crude oils is carried out by converting part of the resids to more valuable hydrocarbon products. The resulting coke has value, depending on its grade, as a fuel (fuel grade coke), electrodes for aluminum manufacture (anode grade coke), etc.

Generally, a residue fraction, such as a petroleum residuum feed is pumped to a pre-heater at a pressure of about 50 psig (345 kPag) to about 550 psig (3.7 MPag), where it is pre-heated to a temperature from about 480° C. to about 520° C. The pre-heated feed is conducted to a coking zone, typically a vertically-oriented, insulated coker vessel, e.g., drum, through an inlet at the base of the drum. Pressure in the drum is usually relatively low, such as about 15 psig (103 kPag) to about 80 psig (551 kPag) to allow volatiles to be removed overhead. Typical operating temperatures of the drum will be between about 410° C. and about 475° C. The hot feed thermally cracks over a period of time (the "coking time") in the coker drum, liberating volatiles composed primarily of hydrocarbon products that continuously rise through the coke mass and are collected overhead. The volatile products are conducted to a coker fractionator for distillation and recovery of coker gases, gasoline boiling range material such as coker naphtha, light gas oil, and heavy gas oil. In an embodiment, a portion of the heavy coker gas oil present in the product stream introduced into the coker fractionator can be captured for recycle and combined with the fresh feed (coker feed component), thereby forming the coker heater or coker furnace charge. In addition to the volatile products, the process also results in the accumulation of coke in the drum. When the coker drum is full of coke, the heated feed is switched to another drum and hydrocarbon vapors are purged from the coke drum with steam. The drum is then quenched with water to lower the temperature from about 200° F. (93° C.) to about 300° F. (149° C.), after which the water is drained. When the cooling step is complete, the drum is opened and the coke is removed by drilling and/or cutting using high velocity water jets. The coke removal step is frequently referred to as "decoking".

Conventional coke processing aids can be used, including the use of antifoaming agents. The process is compatible with processes which use air-blown feed in a delayed coking process operated at conditions that will favor the formation of isotropic coke.

The volatile products from the coker drum are conducted away from the process for further processing. For example, volatiles can be conducted to a coker fractionator for distillation and recovery of coker gases, coker naphtha, light gas oil, and heavy gas oil. Such fractions can be used, usually but not always following upgrading, in the blending of fuel and lubricating oil products such as motor gasoline, motor diesel oil, fuel oil, and lubricating oil. Upgrading can include separations, heteroatom removal via hydrotreating and non-hydrotreating processes, de-aromatization, solvent extraction, and the like. The process is compatible with processes where at least a portion of the heavy coker gas oil present in the product stream introduced into the coker fractionator is captured for recycle and combined with the fresh feed (coker feed component), thereby forming the coker heater or coker furnace charge. The combined feed ratio ("CFR") is the volumetric ratio of furnace charge (fresh feed plus recycle oil) to fresh feed to the continuous delayed coker operation. Delayed coking operations typically employ recycles of about 5 vol. % to about 25 vol. % (CFRs of about 1.05 to about 1.25). In some instances there is 0 recycle and sometimes in special applications recycle up to 200%.

In an embodiment, pressure during pre-heat ranges from about 50 psig (345 kPag) to about 550 psig (3.8 MPag), and pre-heat temperature ranges from about 480° C. to about 520° C. Coking pressure in the drum ranges from about 15 psig (101 kPag) to about 80 psig (551 kPag), and coking temperature ranges from about 410° C. and 475° C. The coking time ranges from about 0.5 hour to about 24 hours.

Feed Splitting Between Coking and Slurry Hydroconversion

Conventionally, one of the alternatives to performing slurry hydrocracking on a heavy oil feed has been to instead pass the heavy oil feed into a coker. Slurry hydroconversion typically provides a greater yield of liquid products than coking of a similar feed. However, achieving this greater yield of liquid products can require a substantial increase in the amount of hydrogen required for processing. In particular, slurry hydroconversion requires a catalyst, elevated temperatures, and potentially high partial pressures of hydrogen. By contrast, coking is a thermal process so that only elevated temperatures are required. Thus, the additional cost required in operating a slurry hydroconversion reactor can potentially be greater than the value of the increased liquid yield.

Instead of using coking as an alternative to slurry hydroconversion, coking and slurry hydroconversion can be used as complementary processes for processing different heavy oil feedstocks and/or different portions of a heavy oil feedstock. At a given level of conversion, the amount of converted liquid product generated by slurry hydroconversion is relatively insensitive to the nature of the feed. By contrast, the amount of liquid products generated during coking is dependent on the amount of Conradson carbon residue in the feedstock. The liquid products generated by conversion of a heavy oil feed during slurry hydroconversion can represent liquids ranging from naphtha boiling range compounds to heavy vacuum gas oils. For the heavy vacuum gas oils portion of the liquid products, the end of the converted liquid product range can correspond to the conversion temperature used for measuring conversion of the feed. Thus, the high end temperature for the converted liquids can be about 1050° F. (566° C.) or less, or about 1000° F. (5380° C.) or less, or about 975° F. (524° C.) or less, or about 950° F. (510° C.) or less.

To use coking and slurry hydroconversion as complementary processes, one option is to process different feeds in different processes, with a first heavy oil feed being processed by coking and a second heavy oil feed being processed by slurry hydroconversion. In this type of option, the first heavy oil feed can correspond to a feed with a lower Conradson carbon residue value than the second heavy oil feed. The Conradson carbon residue value of the first heavy oil feed can be less than the value for the second heavy oil feed by at least about 5 wt %, such as a difference between the residue values for the feeds of at least about 10 wt % or at least about 15 wt %. Alternatively or additionally, the first heavy oil feed can have a Conradson carbon residue of about 27.5 wt % or less, such as about 25 wt % or less, or about 22.5 wt % or less, or about 20 wt % or less. The second heavy oil feed can have a Conradson carbon residue of at least about 30 wt %, such as at least about 32.5 wt %, or at least about 35 wt %.

In another aspect, a heavy oil feedstock can be separated or fractionated into a portion with a reduced Conradson carbon residue (CCR) weight and a fraction with an increased CCR weight. This type of separation can be performed, for example, using a to membrane separation technique, such as the membrane separation described in U.S. Pat. No. 7,897,828, the entirety of which is incorporated herein by reference. This can allow for formation of a permeate stream with a CCR weight that is reduced by at least 10%, such as at least 20%. Separating a heavy oil feed into a lower CCR weight portion (permeate from a membrane separation) and a higher CCR weight portion can then allow the permeate to then be processed via coking while the retentate is processed via slurry hydroconversion.

Example 1—Comparison of Coking and Slurry Hydroconversion for Light and Heavy Feeds The benefits of using both coking and slurry hydroconversion for treatment of heavy feeds can be shown based on a comparison of the liquid yields for coking and slurry hydroconversion on feeds with different Conradson carbon residue values. Table 1 shows properties for vacuum resid fractions generated from crude oils from two different sources. Feed 1 in Table 1 represents a lighter feed while Feed 2 corresponds to a heavier feed. As shown in Table 1, the Conradson carbon residue for Feed 1 is 24.1 wt % while the residue value for Feed 2 is 33.5 wt %.

TABLE 1

| Feed Properties | | |
|---|---|---|
| Vacuum Resid Properties | Feed 1 | Feed 2 |
| Specific Gravity | 1.035 | 1.082 |
| Sulfur, wt % | 4.55 | 6.22 |

TABLE 1-continued

| Feed Properties | | |
|---|---|---|
| Vacuum Resid Properties | Feed 1 | Feed 2 |
| Nitrogen, wt % | 0.38 | 0.88 |
| CCR, wt % | 24.1 | 33.5 |
| Nickel, wppm | 27.1 | 182.4 |
| Vanadium, wppm | 94.5 | 463.6 |
| Asphaltenes, wt % | 9.0 | 30.5 |
| Cut Vol %, 975° F.+ (524° C. +) | 18.3 | 35.4 |
| Cut Vol %, 1050 F.+ (566° C. +) | 14.1 | 29.1 |

Table 2 shows the resulting products from processing the vacuum resid feeds in Table 1 using a variety of processes. In Table 2, "Delayed Coke" refers to an example of using a delayed coking process to process a feed. "Slurry HDP (average)" refers to the average results from performing multiple different types of slurry hydroconversion on a feed, including slurry hydroconversion performed under different reactor conditions (e.g., temperature, $H_2$ pressure) and different reactor configurations. It is noted that the total liquid product yield from slurry hydroconversion was relatively constant at a constant level of conversion. For each of the slurry hydroconversion methods in the average, the total liquid product yield differed for Feed 1 and Feed 2 by less than 3 wt % of the feedstock.

The "conversion" row in Table 2 represents the amount of conversion of feedstock relative to a 975° F. (524° C.) cut point for separating vacuum gas oil from bottoms or pitch from the slurry hydroconversion process. For the conversion row, the range of conversion values tested for the three types of slurry hydroconversion is indicated instead of providing the average value. For coking, the amount of "conversion" is not provided, as some of the "conversion" performed during coking results in formation of coke instead of liquid products. The individual products shown correspond to light ends, naphtha, distillate (fuels), vacuum gas oil (VGO), coke or pitch (depending on whether the process is coking or slurry HDP), and hydrogen consumption. Light ends includes $H_2S$, $NH_3$, water, and C1-C4 molecules.

TABLE 2

| | Feed 1—Delayed Coke | Feed 1—Slurry HDP (average) | Feed 2—Delayed Coke | Feed 2—Slurry HDP (average) |
|---|---|---|---|---|
| Conversion (vol %) | | 90-97 | | 90-97 |
| Light ends (wt %) | 9.6 | 15.5 | 12.0 | 16.9 |
| Naphtha (wt %) | 11.1 | 16.0 | 10.7 | 16.0 |
| Distillate (wt %) | 21.5 | 40.5 | 18.0 | 40.5 |
| VGO (wt %) | 27.8 | 24.4 | 21.4 | 24.3 |
| Coke or Pitch (wt %) | 30.0 | 6.1 | 37.9 | 6.0 |
| Hydrogen Consumption (scf/B) | 0 | 2000 (337 $Nm^3/m^3$) | 0 | 2500 (421 $Nm^3/m^3$) |

As shown in Table 2, the liquid product yield from slurry hydroconversion is relatively constant at a constant level of conversion. For each of the slurry hydroconversion methods, the total liquid product yield differed for Feed 1 and Feed 2 by less than 3 wt % of the feedstock. Due to the heavier nature of Feed 2, additional hydrogen is consumed to achieve the liquid product yield. However, the amount of total liquid product relative to the amount of feedstock is relatively similar, even though the CCR content of Feed 1 is about 10 wt % higher than the CCR value for Feed 1.

By contrast, coking of Feed 1 and Feed 2 results in production of substantially different amounts of total liquid product. Coking of Feed 1 results in a total liquid product of about 61 wt % of the original feed. Coking of Feed 2 results in a total liquid product of about 50 wt % of the original feed. Thus, a change of about 10 wt % in Conradson carbon value resulted in about a 10 wt % change in total liquid product.

Another way of understanding the results in Table 2 is to consider the marginal gain in liquid yield relative to the amount of hydrogen consumption. Performing slurry hydroconversion on Feed 1 resulted in an increase in total liquid yield of about 20 wt % relative to the feedstock, at the cost of using about 1700-2300 scf/B (287-388 $Nm^3/m^3$) of hydrogen. In comparison with Feed 1, performing slurry hydroconversion on Feed 2 resulted in an additional about 10 wt % of yield relative to the feedstock at a marginal increase in hydrogen consumption of about 400-700 scf/B (67-118 $Nm^3/m^3$). This demonstrates that use of slurry hydroconversion on the feed with a higher Conradson carbon value (Feed 2) provided a greater advantage relative to the amount of required hydrogen consumption. By selectively using coking to process less challenged feeds while using slurry hydroconversion to process higher Conradson carbon value (or otherwise more challenged) feeds, the hydrogen resources in a refinery can be preserved for higher value uses. This can allow more challenged feeds to be processed to using slurry hydroconversion, so that a yield of at least about 55 wt % of liquid products, or at least about 60 wt % of liquid products, can be achieved for a more challenged feed.

Integrated Coking and Slurry Hydroconversion

Another option for combining coking with slurry hydroconversion is to operate a coker in a "once-through" manner or with a reduced amount of product recycle. The portion of the coking product that still corresponds to a vacuum resid portion, such as a fraction that boils at about 975° F. (524° C.) or greater, can then be passed into a slurry hydroconversion reactor.

In a typical coker configuration, the products generated from the coker are fractionated to produce gas phase products (such as contaminant gases or light ends), liquid phase products (such as coker naphtha, coker distillates, and coker gas oils), unconverted resid or bottoms, and coke. The severity of the coker reaction conditions are set to produce about 10 wt % to about 30 wt % of bottoms. The bottoms (unconverted resid) portion of the products is typically recycled back to the coker for further conversion, so that the net products from coking do not include a resid fraction. In FIG. 2, this is represented by recycle flow 26. Recycling the bottoms fraction to extinction increases the yield of naphtha distillate, and gas oil products. However, recycling the bottoms to extinction also increases the amount of light ends/gases and the amount of coke.

Instead of recycling the bottoms fraction, at least a portion of the coker bottoms fraction can be passed into a slurry hydroconversion reactor. This allows the coker to handle the easier portions of a feed for conversion while still providing improved yield based on the use of slurry hydroconversion to handle the more difficult portions (i.e., the portion that is not converted during the initial pass). This allows for increased yield of liquid product while avoiding the consumption of hydrogen for conversion of the easier to process portions of a resid (or other heavy oil) feed.

Figure 3:
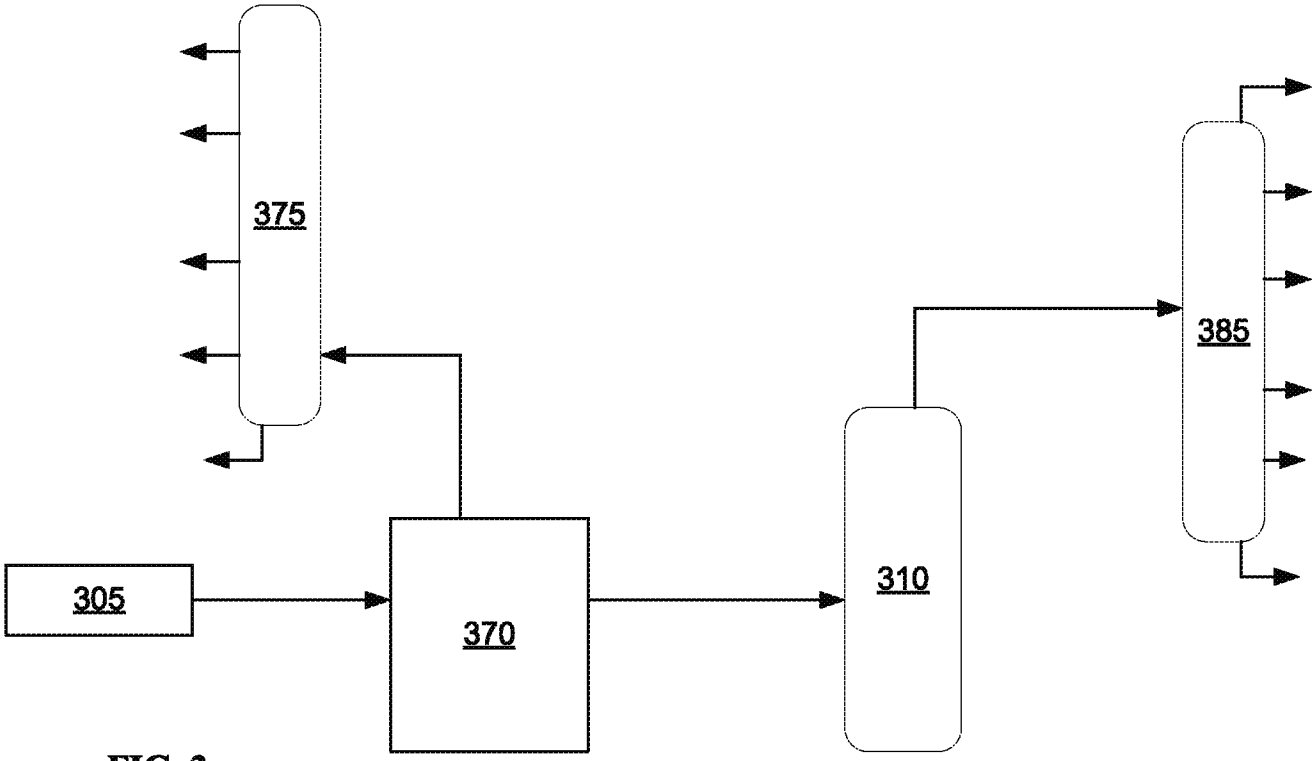
FIG. 3 shows an example of integration of a coker with a slurry hydroconversion reaction system.

FIG. 3 shows an example of how a coker in "once-through" operation can be integrated with a slurry hydroconversion reactor. A feedstock 305 can be introduced into a coker 370. This generates a plurality of desired liquid products, which can be fractionated using fractionator 375. Instead of recycling the entire coker bottoms, at least a portion of the coker bottoms can be passed into a slurry hydroconversion reactor 310. This generates an additional set of liquid products that can be separated in a fractionators, such as fractionator 385. By performing an initial stage of processing in a coker, hydrogen consumption is reduced, as a coker does not require hydrogen as an input flow. Additionally, a catalyst is not used, so difficulties associated with catalyst use and recycling are reduced. In other words, using an initial coking stage reduces the amount of feed that is processed under conditions involving exposing a feed to a catalyst at elevated hydrogen pressure.

Table 3 shows an example of traditional coker operation and once-through operation for coking of two different feeds. In Table 3, the severity of the coking reaction is selected so that about 12.5 wt % of the feed is not converted during each pass through the coker. In Table 3, Feed A corresponds to a resid fraction with a Conradson carbon residue of about 22 wt %. Feed B corresponds to a resid fraction with a Conradson carbon residue of about 28 wt %. For the values in Table 3, the naphtha/light gas oil cut point is 430° F. (221° C.); the light gas oil/heavy gas oil cut point is 650° F. (343° C.); and the heavy gas oil/bottoms cut point is 975° F. (524° C.).

TABLE 3

| | Feed A | | Feed B | |
|---|---|---|---|---|
| Component (wt %) | Recycle | Once-Thru | Recycle | Once-Thru |
| Product Gas ($C_4$-minus) | 11.2 | 9.8 | 12.9 | 11.2 |
| Naphtha ($C_5$-430° F.) | 15.3 | 13.3 | 14.4 | 12.5 |
| Light Gas Oil (430-650° F.) | 12.1 | 10.7 | 10.2 | 8.9 |
| Heavy Gas Oil (650-975° F.) | 34.7 | 30.0 | 27.1 | 24.1 |
| Bottoms (975° F.-plus) | 0.0 | 12.3 | 0.0 | 12.2 |
| Gross Coke | 26.7 | 23.9 | 35.4 | 31.1 |

For Feed A, performing a once-through coking process at a severity corresponding to about 12.5 wt % of bottoms results in generation of about 24 wt % coke. This amount of coke corresponds to about 27.3% of the feedstock that was converted in the coker (conversion was actually 87.7%). If the bottoms are recycled to extinction, the wt % of coke increases to 26.9 wt %. However, since 100% of the feed is now converted, the percentage of feedstock converted into coke is also 26.9 wt %. Thus, in a comparison of the amount of coke formed relative to the amount of feed that is converted in the coker, recycling the bottoms for Feed A resulted in a decrease in the percentage of coke formed relative to the amount of converted feedstock. By contrast, performing a once-through coking process on Feed B results in generation of about 31 wt % coke. At 87.8% conversion, the amount of coke formed corresponds to 35.4% of the converted feed. Recycling the bottoms for Feed B results in generation of 35.4 wt % coke, so that the percentage of coke formation is not changed.

Table 3 shows that as the amount of Conradson carbon residue in a feed increases, the amount of additional feed that is lost to coke formation in an extinction recycle configuration also increases. For feeds with a Conradson carbon residue of at least about 30 wt %, such as at least about 32.5 wt % or at least about 35 wt %, this can lead to an increase in the percentage of the feed that is converted to low value coke. Instead of performing extinction recycle on the coker bottoms for such a feed, the coker bottoms can be processed by slurry hydroconversion. This allows an initial coking of a heavy feed to form liquid products from the portion of a feed that is easier to convert. The remaining bottoms can then be converted to liquid products using slurry hydroconversion, which is suitable for effective conversion of more difficult feeds into liquid products.

In an aspect, a coker operated at least partially in once-through mode and a slurry hydroconversion reactor can be used for processing of a heavy oil feed. The coker can be operated under effective conditions to produce about 5 wt % to about 25 wt % of bottoms (unconverted heavy oil). All of the bottoms can be passed to the slurry hydroconversion reactor, or at least a portion of the bottoms can be recycled to the coker. The slurry hydroconversion reactor can then be operated at a sufficient severity to achieve at least about 80% conversion of the coker bottoms, such as at least about 90% conversion of the coker bottoms.

Processing of Pitch from Slurry Hydroconversion

The processing conditions in a slurry hydroconversion reactor can be selected to achieve a desired level of conversion of a heavy oil feedstock, such as at least about 90% conversion of the feedstock to products boiling below 975° F. (or another conversion temperature), or at least about 95% conversion, or at least about 97.5% conversion. The remaining unconverted portion of the feed from slurry hydroconversion represents an unconverted bottoms or "pitch" product.

The pitch generated during slurry hydroconversion is often a challenging product to handle within a refinery. The pitch from a slurry hydroconversion reactor tends to have both a high metals content and a high CCR weight percentage. Attempting to hydroprocess the pitch is typically not desirable, as the amount of processing required to yield liquid products is not justified by the corresponding value of the resulting liquid products.

One option for disposing of the slurry hydroconversion pitch is to use the pitch as a filler material for another application. For example, the pitch can potentially be used as additional material for asphalt production. However, incorporation of pitch into an asphalt feed can reduce the value of the asphalt feed for some applications, and additional processing for metals removal may be required prior to such incorporation into an asphalt composition. As another example, the pitch can be used as a fuel in a cement production plant. However, due to the high metals content, the pitch may require further processing in order to be suitable for use even in this application. Additionally, in order to send the material off-site may require the pitch to undergo an additional treatment to solidify or pelletize to make the molecules more transportable.

Because the pitch is a low value product, identifying an end use for the pitch that does not require an intermediate upgrading step is desirable. One option for processing the pitch that avoids an intermediate upgrading step is to use the pitch as at least a portion of a feed to a partial oxidation (POX) process. Partial oxidation processes can convert a wide variety of challenged feeds to syngas type products ($H_2$, CO). A partial oxidation process is relatively insensitive to the metals content of an incoming feed, and therefore can avoid many of the difficulties in using the slurry hydroconversion to pitch for other purposes.

Another option for handling the slurry hydroconversion pitch is to attempt to coke the pitch from a slurry hydroconversion unit. Using the pitch as a portion of a feed to a coker can pose a variety of challenges. Some challenges can be related to the metals content of the slurry hydroconversion pitch. For example, the high metals content of the pitch can cause the resulting coke generated by a coker to have a reduced economic value.

If it is economically desirable to use the pitch as at least a portion of the input stream to a coking unit, the metals content of the pitch can also create difficulties with regard to the operating lifetime of the coking unit. For example, a typical coking unit operates by heating an incoming feed in a coking furnace. During normal operation of a coking furnace, coke will accumulate on the furnace coils. This coke formation in the coking furnace will eventually require an off-line period for the furnace in order to remove the accumulated coke. Passing a high metals content feed into a coking furnace, such as a slurry hydroconversion pitch, can significantly increase the rate of coking in the furnace. As a result, coking of a high metals content feed can reduce the run length of a coker and/or increase on-stream maintenance activities.

In some aspects, the pitch from a slurry hydroconversion reactor can be processed in a coker while reducing or minimizing the impact on the run length of the coker. In a refinery setting, multiple refinery streams are available that can benefit from a coking process. As a result, the pitch from a slurry hydroconversion reaction system can represent a small portion of the total feed to a coker, such as about 15 wt % or less of the coker feed, or about 10 wt % or less. Instead of introducing the slurry hydroconversion pitch portion of the coker feed along with the remainder of the coker feedstock, the pitch portion of the feedstock can be introduced into the coker at a location downstream from the coker furnace(s). For example, the slurry hydroconversion pitch can be introduced directly into the coking drum of a coker, or the pitch can be introduced into the feed after the coker furnace but prior to the coking drum.

Introducing the slurry hydroconversion pitch into the coker at a location downstream from the coker furnace(s) can avoid the difficulties associated with increased coke formation in a coker furnace. Instead, the formation of high metals content coke can be limited to the coke formed in the coking drum. This can lead to formation of a lower value coke product but otherwise has a reduced or minimal impact on the run length of the coker.

ADDITIONAL EMBODIMENTS

Embodiment 1

A method for processing a heavy oil feedstock, comprising: providing a first heavy oil feedstock having a 10% distillation point of at least about 650° F. (343° C.) and a first Conradson carbon residue wt %; providing a second heavy oil feedstock having a 10% distillation point of at least about 650° F. (343° C.) and a second Conradson carbon residue wt %, the second Conradson carbon residue wt % being at least 5 wt % greater than the first Conradson carbon residue wt %; coking the first heavy oil feedstock under effective coking conditions to form at least a first plurality of liquid products and coke; and exposing the second heavy oil feedstock to a catalyst under effective slurry hydroconversion conditions to form at least a second plurality of liquid products, the effective slurry hydroconversion conditions being effective for conversion of at least about 80 wt % of the second heavy oil feedstock relative to a conversion temperature, or at least about 90 wt %, or at least about 95 wt %.

Embodiment 2

The method of Embodiment 1, wherein the first heavy oil feedstock and the second heavy oil feedstock are formed by performing a membrane separation of a third heavy oil feedstock.

Embodiment 3

The method of any of the above embodiments, wherein a 10% distillation point of the first heavy oil feedstock is at least about 700° F. (371° C.), or at least about 750° F. (399° C.), or at least about 900° F. (482° C.), or at least about 950° F. (510° C.), or at least about 1000° F. (538° C.); or wherein a 10% distillation point of the second heavy oil feedstock is at least about 700° F. (371° C.), or at least about 750° F. (399° C.), or at least about 900° F. (482° C.), or at least about 950° F. (510° C.), or at least about 1000° F. (538° C.); or a combination thereof.

Embodiment 4

The method of any of the above embodiments, wherein the first heavy oil has a Conradson carbon residue of about 27.5 wt % or less, or about 25 wt % or less.

Embodiment 5

The method of any of the above embodiments, wherein the second heavy oil has a Conradson carbon residue of at least about 30 wt %, or at least about 32.5 wt %.

Embodiment 6

The method of any of the above embodiments, wherein a combined weight percentage of the first liquid products is at least about 55 wt % of the first heavy oil feedstock, or at least about 60 wt %.

Embodiment 7

The method of any of the above embodiments, wherein exposing the second heavy oil feedstock to a catalyst under effective slurry hydroconversion conditions further comprises forming an unconverted slurry hydroconversion pitch, wherein at least a portion of the unconverted slurry hydroconversion pitch is passed into a partial oxidation unit.

Embodiment 8

The method of any of the above embodiments, wherein exposing the second heavy oil feedstock to a catalyst under effective slurry hydroconversion conditions further comprises forming an unconverted slurry hydroconversion pitch, wherein at least a portion of the unconverted slurry hydroconversion pitch is passed into a coker at a location that is downstream of a coker furnace.

Embodiment 9

The method of Embodiment 8, wherein coking the first heavy oil feedstock further comprises coking at least a portion of the unconverted slurry hydroconversion pitch.

Embodiment 10

The method of any of the above embodiments, further comprising: combining at least a portion of one or more of the first plurality of liquid products with at least a portion of one or more of the second plurality of liquid products; hydroprocessing the combined liquid products; and fractionating the combined liquid products.

Embodiment 11

The method of Embodiment 10, wherein hydroprocessing the combined liquid products comprises hydrotreating the combined liquid products.

Embodiment 12

A method for processing a heavy oil feedstock, comprising: providing a heavy oil feedstock having a 10% distillation point of at least about 650° F. (343° C.); coking the heavy oil feedstock under effective coking conditions to form at least a first plurality of liquid products, coke, and an unconverted coker bottoms, the unconverted coker bottoms portion comprising about 5 wt % to about 25 wt % of the heavy oil feedstock, the unconverted bottoms portion having a 10% distillation point of at least about 900° F. (482° C.); exposing at least a first portion of the unconverted coker bottoms to a catalyst under effective slurry hydroconversion conditions to form at least a second plurality of liquid products, the effective slurry hydroconversion conditions being effective for conversion of at least about 90 wt % of the first portion of the unconverted coker bottoms relative to a conversion temperature, or at least about 80 wt %, or at least about 95 wt %.

Embodiment 13

The method of Embodiment 12, wherein the heavy oil feedstock has a Conradson carbon residue of at least about 27.5 wt %, or at least about 30 wt %, or at least about 32.5 wt %.

Embodiment 14

The method of any of Embodiments 12 to 13, wherein at least a second portion of the unconverted coker bottoms is recycled to the coker.

Embodiment 15

The method of any of Embodiments 12 to 14, wherein at least 90 wt % of the unconverted coker bottoms is converted relative to a conversion temperature of at least about 950° F. (510° C.), or at least about 975° F. (524° C.), or at least about 1050° F. (566° C.).

Embodiment 16

The method of any of Embodiments 12 to 15, wherein exposing the at least a first portion of the coker bottoms to a catalyst under effective slurry hydroconversion conditions further comprises forming an unconverted slurry hydroconversion pitch, wherein at least a portion of the unconverted slurry hydroconversion pitch is passed into a partial oxidation unit.

Embodiment 17

The method of any of Embodiments 12 to 15, wherein exposing the at least a first portion of the coker bottoms to a catalyst under effective slurry hydroconversion conditions further comprises forming an unconverted slurry hydroconversion pitch, wherein at least a portion of the unconverted slurry hydroconversion pitch is passed into a coker at a location that is downstream of a coker furnace.

Embodiment 18

The method of Embodiment 17, wherein coking the heavy oil feedstock further comprises coking at least a portion of the unconverted slurry hydroconversion pitch.

Embodiment 19

The method of any of embodiments 12-18, wherein a 10% distillation point of the first heavy oil feedstock is at least about 700° F. (371° C.), or at least about 750° F. (399° C.), or at least about 900° F. (482° C.), or at least about 950° F. (510° C.), or at least about 1000° F. (538° C.).

What is claimed is:

1. A method for processing a heavy oil feedstock, comprising:

providing a first heavy oil feedstock having a 10% distillation point of at least about 650° F. (343° C.) and a first Conradson carbon residue wt %;

providing a second heavy oil feedstock having a 10% distillation point of at least about 650° F. (343° C.) and a second Conradson carbon residue wt %, the second Conradson carbon residue wt % being at least 5 wt % greater than the first Conradson carbon residue wt %;

coking the first heavy oil feedstock under effective coking conditions to form at least a first plurality of liquid products and coke;

exposing the second heavy oil feedstock to a catalyst under effective slurry hydroconversion conditions to form at least a second plurality of liquid products, the effective slurry hydroconversion conditions being effective for conversion of at least about 90 wt % of the second heavy oil feedstock relative to a conversion temperature; and wherein the first heavy oil feedstock and the second heavy oil feedstock are formed by performing a membrane separation of a third heavy oil feedstock.

2. The method of claim 1, wherein a 10% distillation point of the first heavy oil feedstock is at least about 900° F. (482° C.).

3. The method of claim 1, wherein the first heavy oil has a Conradson carbon residue of about 27.5 wt % or less.

4. The method of claim 1, wherein the second heavy oil has a Conradson carbon residue of at least about 30 wt %.

5. The method of claim 1, wherein a combined weight percentage of the first liquid products is at least about 55 wt % of the first heavy oil feedstock.

6. The method of claim 1, wherein exposing the second heavy oil feedstock to a catalyst under effective slurry hydroconversion conditions further comprises forming an unconverted slurry hydroconversion pitch, wherein at least a portion of the unconverted slurry hydroconversion pitch is passed into a partial oxidation unit.

7. The method of claim 1, wherein exposing the second heavy oil feedstock to a catalyst under effective slurry hydroconversion conditions further comprises forming an unconverted slurry hydroconversion pitch, wherein at least a portion of the unconverted slurry hydroconversion pitch is passed into a coker at a location that is downstream of a coker furnace.

8. The method of claim 7, wherein coking the first heavy oil feedstock further comprises coking at least a portion of the unconverted slurry hydroconversion pitch.

9. The method of claim 1, further comprising:

combining at least a portion of one or more of the first plurality of liquid products with at least a portion of one or more of the second plurality of liquid products;

hydroprocessing the combined liquid products; and fractionating the combined liquid products.

10. The method of claim 9, wherein hydroprocessing the combined liquid products comprises hydrotreating the combined liquid products.

* * * * *